US006405667B2

(12) United States Patent
Fenzel

(10) Patent No.: US 6,405,667 B2
(45) Date of Patent: Jun. 18, 2002

(54) SEWING APPARATUS FOR PRODUCING A SEAM HAVING A PREDETERMINED SHAPE

(75) Inventor: Horst Fenzel, Oerlinghausen (DE)

(73) Assignee: Dürkopp Adler AG (DE)

( * ) Notice: Subject to any disclaimer, the term of this patent is extended or adjusted under 35 U.S.C. 154(b) by 0 days.

(21) Appl. No.: 09/727,157

(22) Filed: Nov. 30, 2000

(30) Foreign Application Priority Data

Dec. 2, 1999 (DE) ..... 199 58 008

(51) Int. Cl.[7] ..... D05B 21/00
(52) U.S. Cl. ..... 112/470.18
(58) Field of Search ..... 112/470.18

(56) References Cited

U.S. PATENT DOCUMENTS 4,406,234 A * 9/1983 Johnson et al. ..... 112/470.18
5,081,943 A * 1/1992 Nakanishi ..... 112/470.18
5,553,565 A * 9/1996 Ono et al. ..... 112/470.18

FOREIGN PATENT DOCUMENTS

DE 2164151 12/1972
DE 3819136 5/1990
DE 3932226 5/1990
DE 3938819 12/1997

* cited by examiner

*Primary Examiner*—Andy Falik
(74) *Attorney, Agent, or Firm*—Ostrolenk, Faber, Gerb & Soffen, LLP

(57) ABSTRACT

Sewing apparatus, especially a contour sewing machine for a sewing unit, comprising a vertically reciprocating needle (2) and a sewing material holder (7, 7') which moves relative to the needle. This apparatus produces a seam having a predetermined shape. The holder (7, 7') is moveable in directions (X, Y) extending at an angle to one another in a plane, the movements being generated by two independent motors (24, 40) and the holder (7, 7') being releasably connectable to a bearer (14) driven in one direction (Y) and engaging a drive operative in the other direction (X). The holder (7, 7') is mountable on a guide rod (5, 5') rigidly connected to the bearer (14) and is connectable via at least one connecting element (12) to the drive for the other direction (X).

12 Claims, 6 Drawing Sheets

SEWING APPARATUS FOR PRODUCING A SEAM HAVING A PREDETERMINED SHAPE

The invention relates to sewing apparatus, more especially a contour sewing machine for a sewing unit, comprising a vertically reciprocating needle and a holder of material for sewing movable relative thereto which, in order to make a seam having a predetermined shape, is movable in two directions at an angle to one another in a plane, the movements being generated by two independent motors and the holder being releasably connected to a bearer driven in one direction and coming into engagement with a drive operating in the other direction.

DE 21 64 151 A1 (corresponding to U.S. Pat. No. 3,752,058) describes a sewing installation wherein the holder of material for sewing is mountable on a slide. The slide is permanently connected to a belt rotating in a horizontal plane. The belt is mounted on a bearer disposed so as to be movable in the longitudinal direction of the sewing machine (the Y direction) transversely to the driven direction. The connection between the holder and the slide can be electromagnetic. The holder and the material for sewing which it carries is fastened on the slide in front of the sewing machine, conveyed in the transverse direction (the X direction) through the stitch-forming region of the sewing machine, and removed behind the sewing machine.

One disadvantage of this sewing installation is that the slide must be moved back each time after reaching the place where the material for sewing is removed, so as to be loaded with another holder. The idle travel increases the cycle times of the machine and seriously affects the production costs in the clothing industry. In addition, heavy masses have to be moved in reciprocation, which means that the motor driving the slide must be designed correspondingly and thus increases the cost of producing the sewing installation.

A sewing installation according to the preamble is known for example from DE 39 38 819 A1 (corresponding to U.S. Pat. No. 5,127,348). In this sewing installation the holder is moved through the stitch-forming region of a stationary sewing machine. The holder is positively connected to the bearer via a toothed drive. The toothed drive comprises a pinion or a rotating toothed belt and a rack for connecting thereto and provided on the holder. The positive connection is produced by a guide block mounted for pivoting on the bearer and comprising a number of rollers which can be mounted on the rack of the holder and thus guide the holder in the transverse direction (the X direction).

With regard to the transverse direction, the holder as before is inserted into the sewing installation in front of the stitch-forming region and removed behind the stitch-forming region. In order to convey the holder from the place of insertion to the place of removal, a very long rack is needed. This results in a very long transit time for the holder. Since the length of the rack depends on the distance between the place of insertion and the place of removal, the holder, independently of the size of the articles for sewing, must be equipped with racks of the same length, which in principle can be considerably longer than necessary for the size of the actually required holder, the result being idle travel over relatively long distances and affecting the economics of the sewing installation. To obtain a high-quality seam, the toothed drive must be accurately made. The accuracy requirements result in relatively high production costs, in addition to the weight of the holder resulting from the rack. In order to limit the production cost, attempts are made to reduce the distance between the places of insertion and withdrawal of the material for sewing to a minimum. The result is that a new holder cannot be inserted until the previous holder has been removed, which likewise affects the economics of the sewing installation. Additional time is lost because of the required accurate positioning when the holder is inserted, so that the seam can be formed at the right place.

Another disadvantage of this sewing installation is that the operator manipulating the holder needs to pay special attention in order not to damage and not to be injured by the rack, which must be made of metal for strength.

DE 39 32 226 A1 discloses a sewing installation comprising an X–Y cable device comprising a guide rail provided on a movable part connected to the holder. The guide rail can be moved relative to guide blocks 17 connected to the unit for driving the holder in the longitudinal direction. This retains its degrees of freedom when the holder is moved in the transverse direction.

DE 38 19 136 C2 describes a sewing unit wherein the holder can be moved by a conveying device between a loading station and the sewing machine. The conveying device has a control-lever transmission system mechanically guided in a guide connected to the drive device and associated with a compensating mechanism.

Starting from this problem, the aim is to improve the sewing apparatus described hereinbefore, a special aim being to increase the output and reduce the cost of producing the insertable holder.

Accordingly, the present invention is directed to sewing apparatus as set out in the opening paragraph of the present specification, in which the holder is mountable via a bearing thereon on a guide rod connected to a fixed place on the bearer and is connectable by at least one connecting element to the drive for the other direction, which coincides with the direction in which the guide rod extends.

As a result of this construction the holder can be inserted and removed at various positions, so that the holders can if required be inserted without spaces between them, thus practically avoiding idle times and appreciably increasing the cycle times of the machine as compared with the prior art. Since the holder does not need a rack and the connecting element for the drive can be made relatively small and low-weight, the holder can be economically produced and its drive can be made correspondingly small. The holder only has to be mounted on a guide rail, where it stays owing to gravity, and the result is that the machine is simpler to operate, since there is no need of time-consuming positioning and locking.

Preferably the holder is mounted on the guide rod via at least one bearing having a substantially U-shaped cross-section and also constituting the only connection to the guide rod. The bearing can be in the form of a simple recess provided in the holder. The recess can be adapted to the contour of the guide rod, resulting in a positive connection.

Advantageously two bearings are provided. These can be disposed on the outer sides of the holder, so that guidance is reliable and the holder cannot become crooked.

Advantageously the connecting element is in the form of a toothed pin and the drive for the transverse direction comprises a rotating toothed belt cooperating therewith. The holder will then be entrained via the pin, which is inexpensive to produce. Alternatively the connecting element can be a toothed segment which engages in the toothed belt.

The toothed belt preferably rotates in a vertical plane. The teeth can therefore be formed on the upper surface, and the tolerance for the arrangement of the connecting element on the holder is increased if the belt is made correspondingly wide. This feature ensures that the holder is connected to its drive by gravity immediately after insertion (placing on the guide rod).

Alternatively the guide rod can be a spindle driven in rotation. It will then also form part of the drive for the transverse direction and can be directly driven by a motor. This enables the number of components to be reduced, since the toothed belt can be omitted. In that case advantageously the holder is supported via a cam engaging in the spindle.

Example embodiments of the present invention will now be described in further detail with reference to the accompanying drawings, in which.

Figure 11:
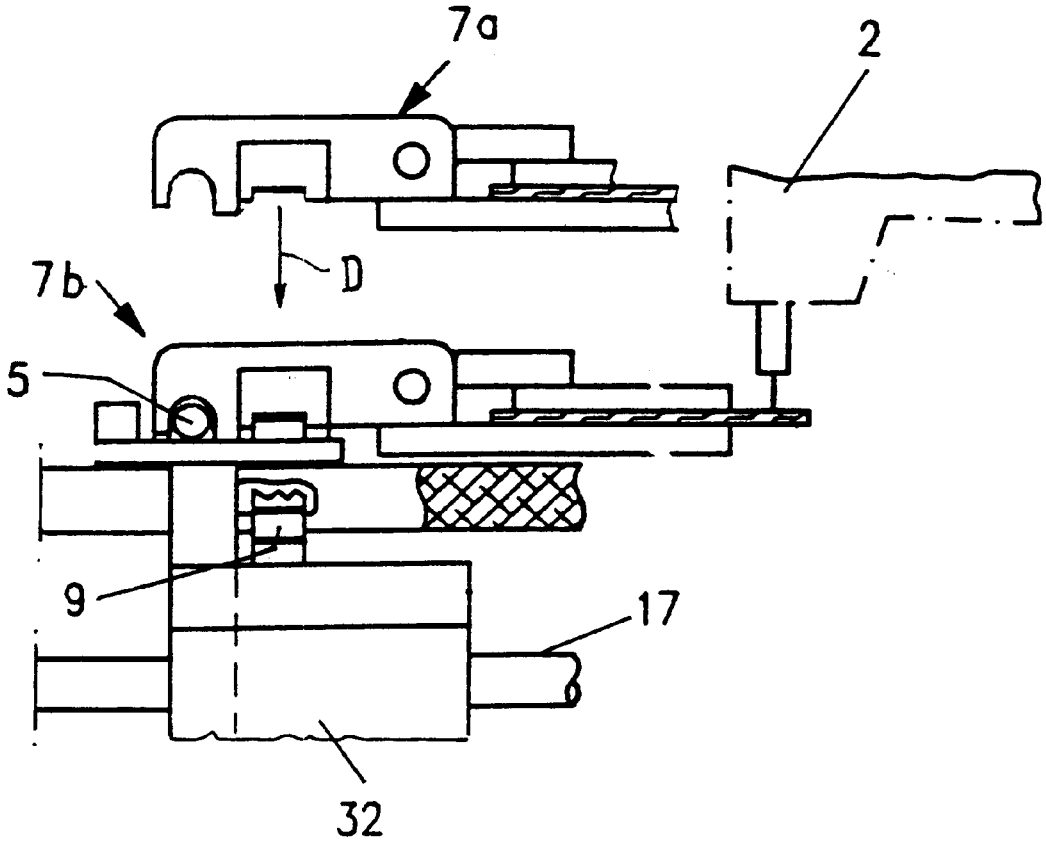
FIG. 11 is an exploded side view related to FIG. 4.

The sewing installation substantially comprises a sewing machine 2 disposed on a table plate 1 and comprising a needle 3, a sewing-machine drive 4 and at least one holder 7 of material for sewing. A bearer 14 is mounted for movement on the table plate in the longitudinal direction of the sewing machine 2 (the Y direction). The bearer 14 has a guide rod 5 which extends over the entire width (X direction) of the table plate 1. The bearer 14 also has a toothed belt driven in rotation in a vertical plane and via which the holder 7 is driven in the transverse direction (the X direction). The holder 7 is received on the guide rod 5 by a loading movement in a direction D from a first position (7*a* in FIG. 11) to a second position (7*b* in FIG. 11) at an insertion place marked 15 and, via a connecting element 49 provided on its underside, comes into engagement with the toothed belt 9. Via the toothed belt 9, the holder 7 holding the material 13 for sewing is conveyed through the needle-forming region, formed by the working region of the needle 3, to a removal place marked 16.

Figure 3:
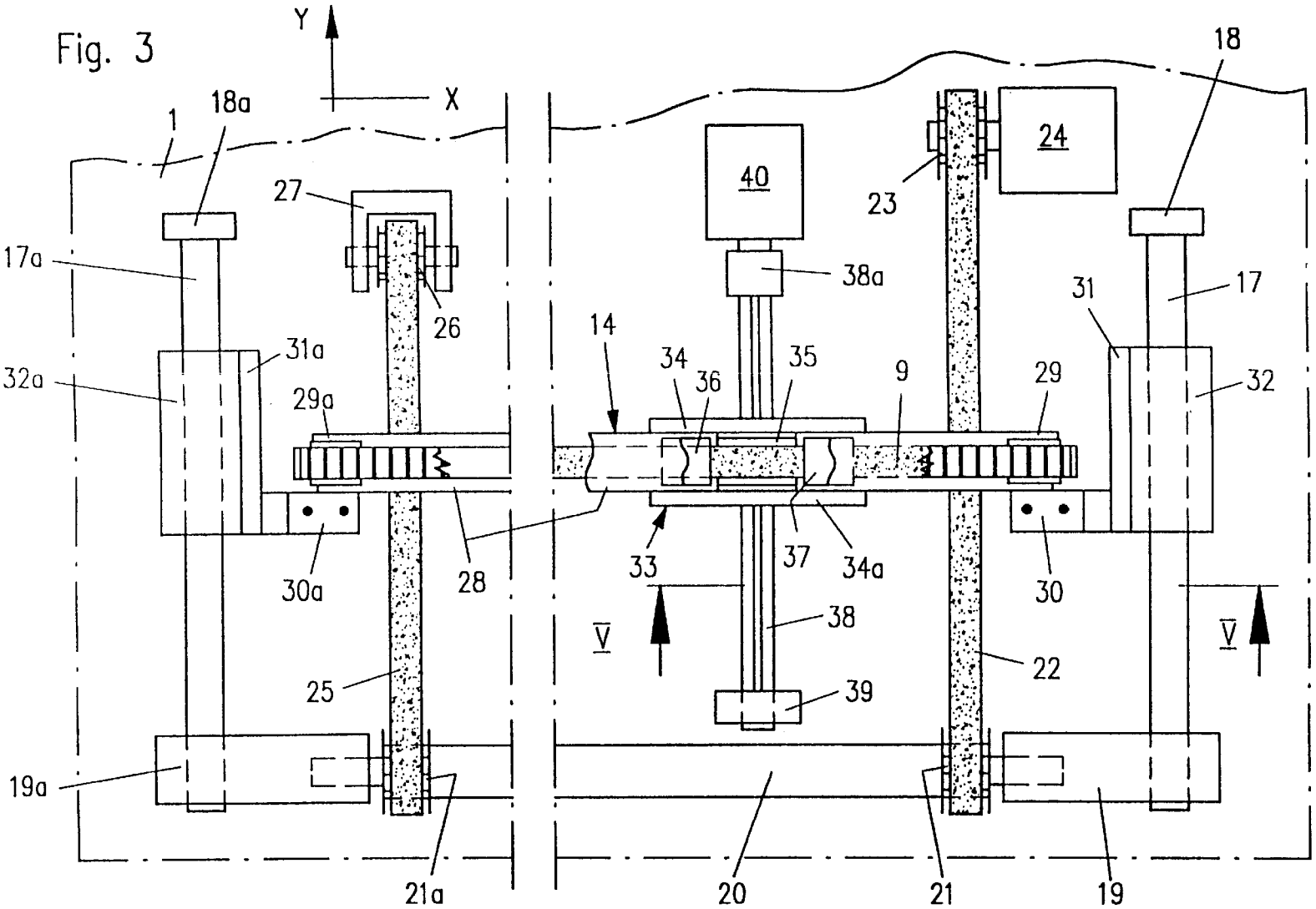
FIG. 3 is a diagram corresponding to FIG. 1 of a device for driving the bearer and the holder.
Figure 12:
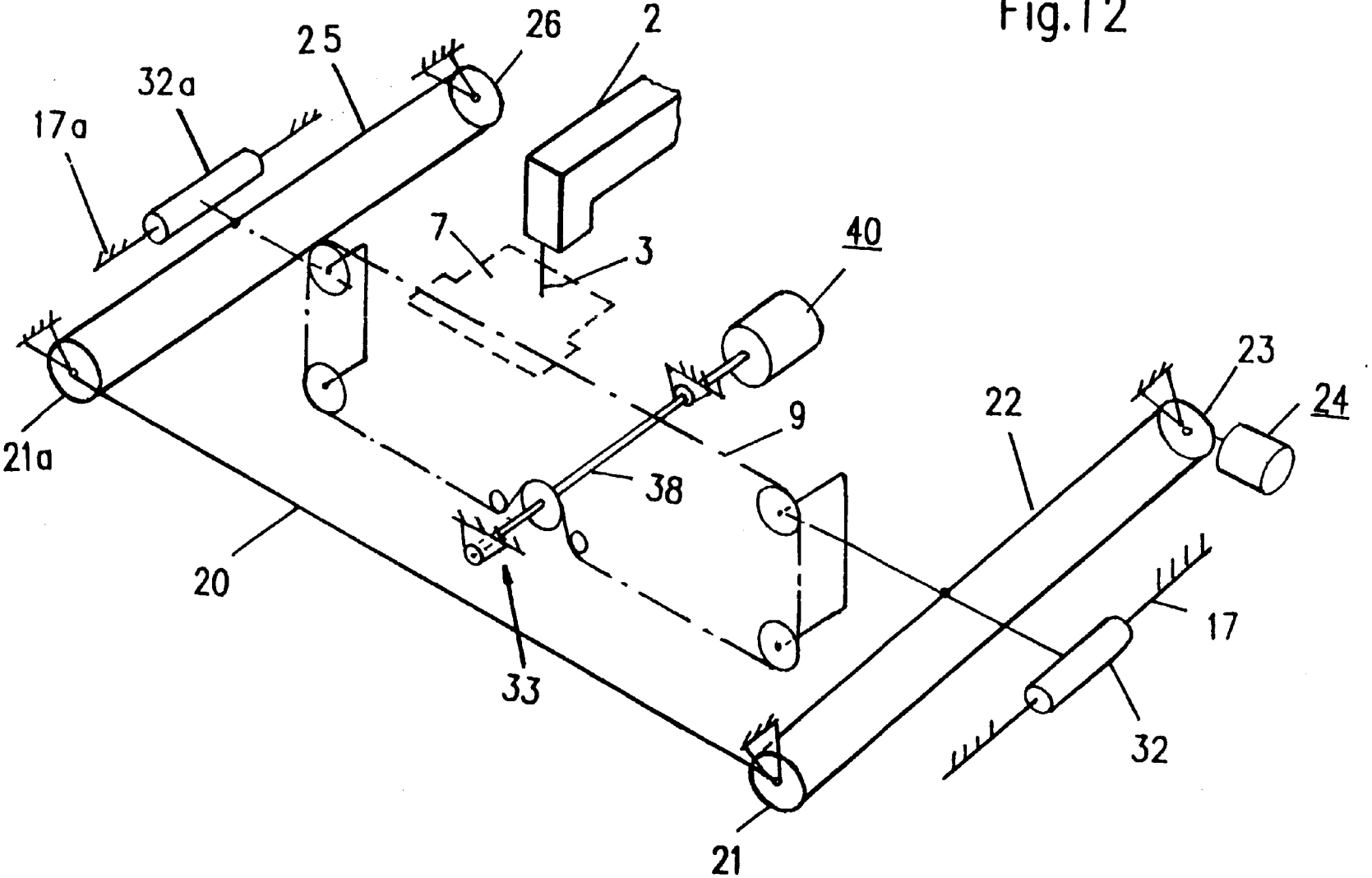
FIG. 12 is a schematic perspective view related to FIG. 3.

FIGS. 3 and 12 show the arrangement for driving the bearer 14. Two guide rods 17, 17*a* extending in a Y direction and parallel to one another are disposed on the underside of the table plate, their ends being received in bearings 18, 18*a* and 19, 19*a* firmly connected to the table plate 1. Ends of a shaft 20 are mounted for rotation in the bearings 19, 19*a* and extends in an X-direction at right angles to the Y-direction. The shaft 20 has two toothed pulleys 21, 21*a* of equal size. The toothed pulley 21 is surrounded by an endless toothed belt 22, the other end of which surrounds a toothed pulley 23 on a drive motor 24 fixed to the underside of the table plate 1.

The toothed pulley 21*a* is surrounded by an endless toothed belt 25, the other end of which surrounds a toothed pulley 26. The toothed pulley 26 is a component of a bearing block 27 fixed to the underside of the table plate 1. The arrangement is such that the belts 22, 25 are under tension.

Figure 2:
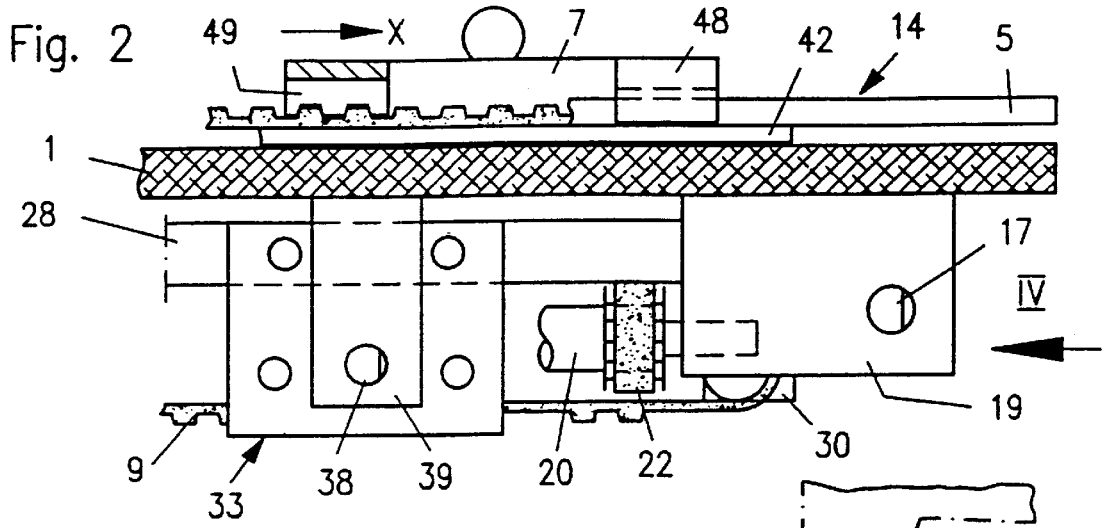
FIG. 2 is a partial view of the sewing installation in the direction of the indicator arrow II in FIG. 1.

In FIG. 2 the top run of the toothed belt 22 is firmly connected to a beam 28 extending in the X direction. The beam 28 is also connected to the top run of the toothed belt 25. The toothed pulleys 21, 21*a* are of equal size, ensuring that when the shaft 20 rotates, the beam 28 is movable in the Y-direction parallel to its original position. One end 29, 29*a* of the beam 28 is permanently connected to a respective bearing member 30, 30*a*. Two guide wheels (not shown) are rotatably mounted (FIG. 5) on each bearing member 30, 30*a* and the toothless side of the toothed belt 9 is supported on them. An intermediate plate 31, 31*a* is fastened to each bearing member 30, 30*a* and fixed to respective sliding bearings 32, 32*a*. The bearings are received for movement without clearance on the guide rods 17, 17*a*.

A guide member 33 for the bottom run of the toothed belt 9 is screwed to the beam 28. The guide member 33 has two similarly shaped plates 34, 34*a*, between which a toothed pulley 35 and two guide wheels 36, 37 are rotatably mounted.

Figure 4:
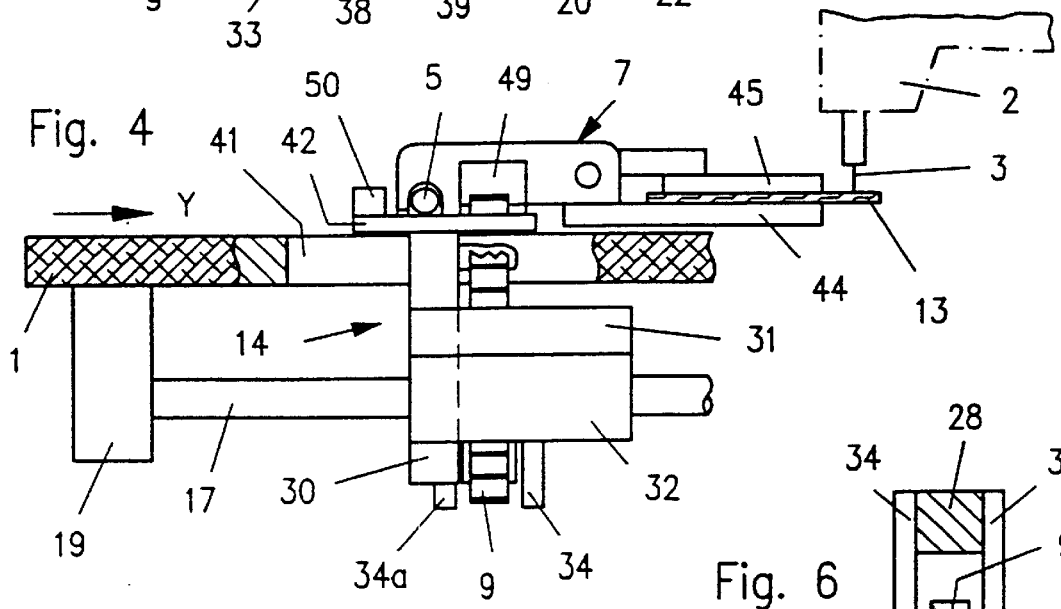
FIG. 4 is a diagrammatic partial view of the sewing installation in the direction of arrow IV in FIG. 2.
Figure 6:
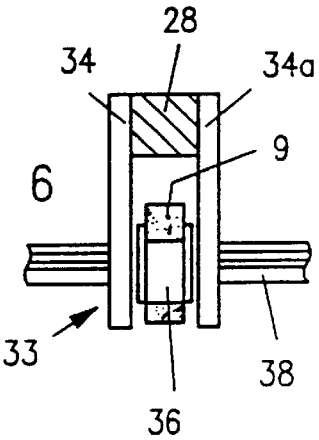
FIG. 6 is a section along the line VI—VI in FIG. 5.
Figure 5:
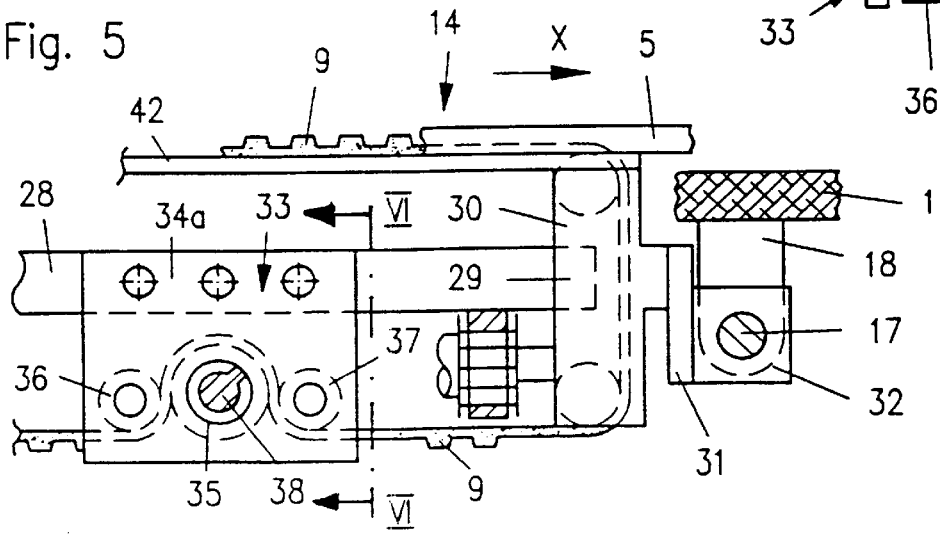
FIG. 5 is a partial view of the sewing installation in section V—V in FIG. 3.

As shown in FIGS. 3, 5 and 6, the bottom run of the toothed belt 9 extends through the guide member 33, and the teeth of the belt 9 come into positive engagement with the toothed pulley 35. The pulley 35 has a bore and groove for receiving a shaft 38 and a spring. The connection of the shaft 38 to the toothed pulley 35 is a rotating and sliding connection, which permits axial movement of the pulley 35 on the shaft 38 and also permits clearance-free transmission of torque. As shown in FIGS. 2 to 4, one end of the shaft 38 is mounted in a bearing 39, fixed to the underside of the table plate 1. The free end of shaft 38 is connected by a coupling 38*a* to a drive motor 40 fastened to the underside of the table plate 1.

The table plate 1 is formed with notches 41, 41*a* through which the upper ends of the bearing members 30, 30*a* project with clearance. Ends of a metal sheet 42 are fastened (FIGS. 4 and 5) to the top ends of the bearing members 30, 30*a*. The construction is such that the sheet 42 extends with clearance of about 1 millimetre above and parallel to the bearing surface of the table plate 1. The sheet 42 supports the top run of the toothed belt 9, which rests on it.

Figure 7:
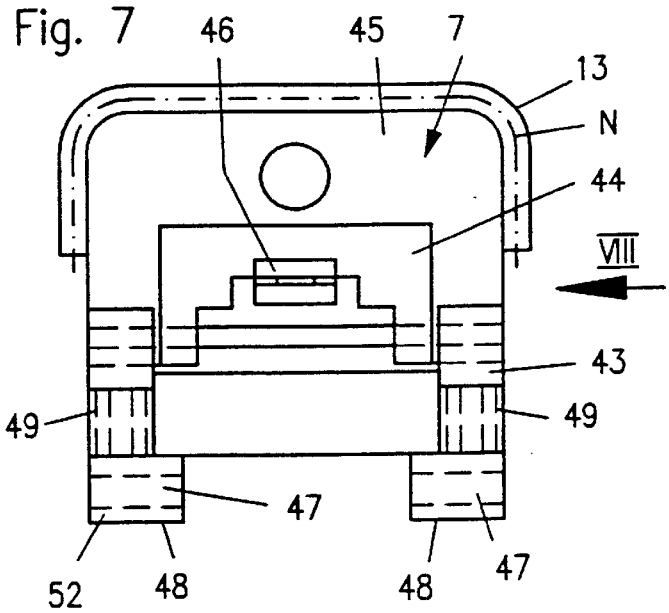
FIG. 7 is a plan view of a first example embodiment of the holder.
Figure 8:
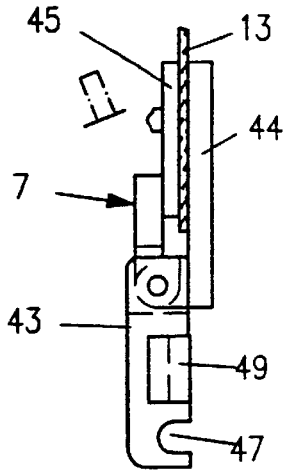
FIG. 8 is a view of the holder in the direction of arrow VIII in FIG. 7.

The holder 7 (FIGS. 7 and 8) comprises a base member 43 on which a top part 45 is pivotable on a bottom part 44. The material 13 for sewing is clamped between the top part 45 and the bottom part 44, the top part 45 being held in the swung-down position by a lock 46 on the bottom part 44. The top part 45 and the bottom part 44 have matching external shapes, equidistant from the curve of a seam N for producing in the material 13 for sewing. The underside of the base member 43 has a U-shaped recess 47 (FIG. 8). The recess 47 is semi-circular on its inside, the shape being adapted to the diameter of the guide rod 5. As FIG. 7 shows, the recess 47 does not extend all through the base member 43; instead two projections 48 extend out from the holder 7. Connecting elements 49 in the base member 43 are provided behind the recess 47. The connecting elements 49 can be in the shape of a toothed pin or a toothed moulded member (toothed segment), the pitch corresponding to the pitch of the teeth on the belt 9. The holder 7, via the recess 47, is mounted on the guide rod 5 and engages the toothed belt 9 via the connecting elements 49. As can be seen, the distance in the Y direction between the guide rod 5 and the toothed belt 9 must be equal to the distance between the recess 47 and the connecting elements 49.

A sensor 50 is provided on the sheet 42 and consequently follows the movements of the bearer 14 in the Y direction. The sensor 50 is disposed in a conveying direction 51 in front of the sewing machine 1, that is between the insertion station 15 and the sewing machine 1. The sensor 50, like the drive motors 24, 40 and the sewing-machine drive 4, is connected for control purposes to a control means (not shown). The sensor 50, on detecting an incoming edge 52 of the holder 7, starts up the sewing machine 2 and drives the motors 24, 40 in co-ordination.

The holder 7 preferably bears coding for scanning in the sewing installation, so that the control means can detect the shape of seam required and can call up a corresponding sewing program, so that production is automatic.

Figure 1:
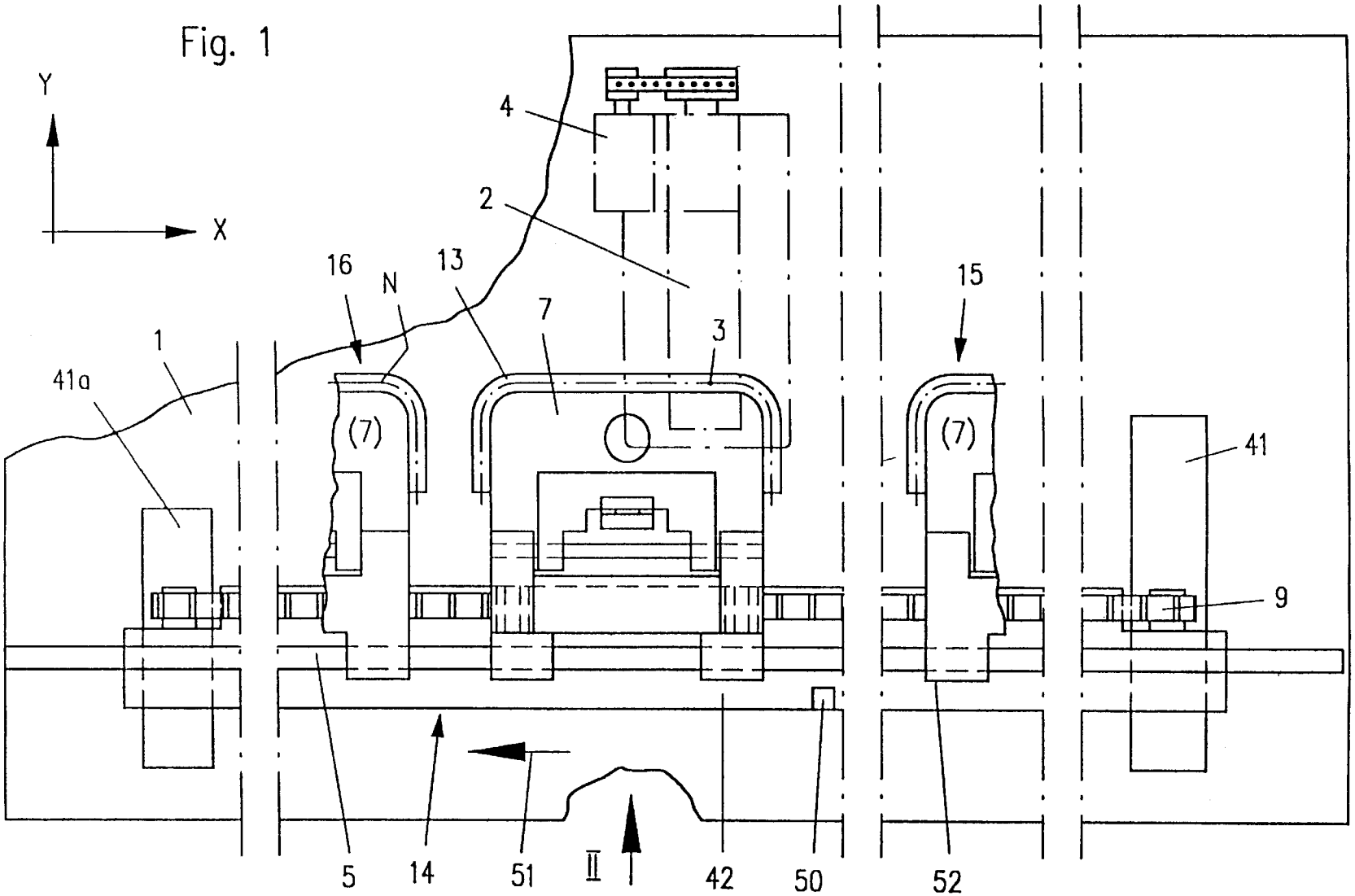
FIG. 1 is a diagrammatic partial view of a sewing installation in plan view.

As FIG. 1 shows, a number of holders 7 at short intervals can be mounted one behind the other on the guide rod 5. The distance between the holders 7 can be made so small that they basically adjoin one another.

Figure 9:
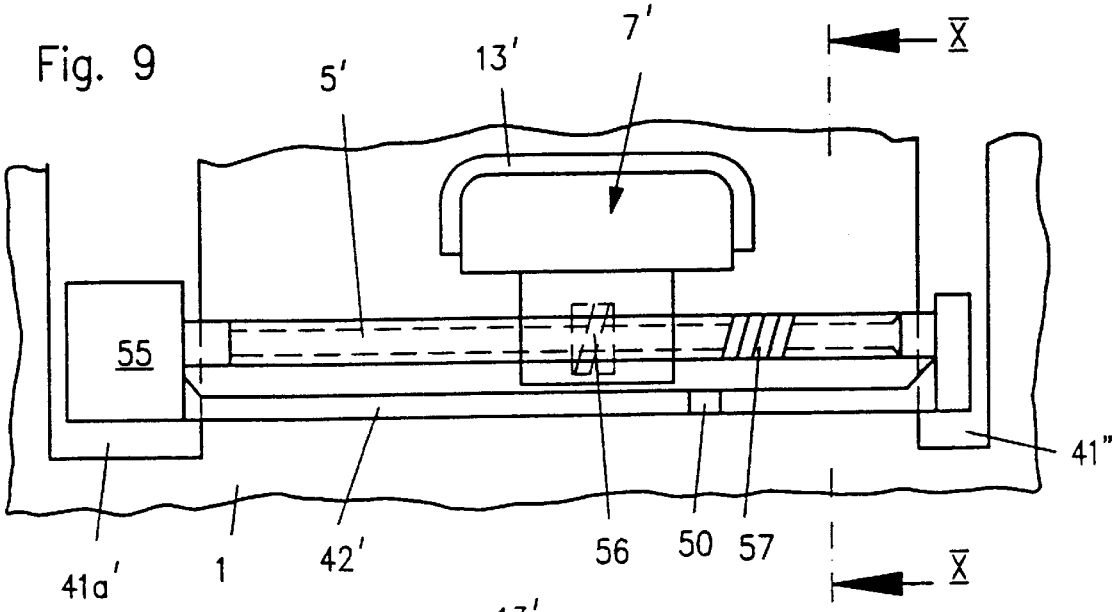
FIG. 9 shows part of a modified sewing installation in accordance with the present invention.
Figure 10:
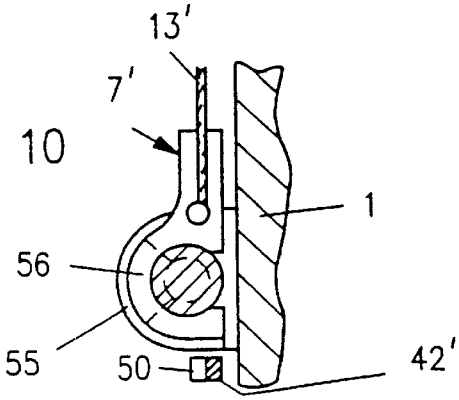
FIG. 10 is a section along the line X—X in FIG. 9.

FIG. 9 shows another example embodiment, in which the guide rod 5 is a spindle 5' driven in rotation by a motor 55. The holder 7' has a corresponding connecting rod 56 in the form of a threaded member engaging in the thread 57 of the spindle 5'. This feature simplifies the construction of the sewing installation, since there is no need for toothed belts extending in the X direction.

| List of reference numbers | |
|---|---|
| 1 | Table plate |
| 2 | Sewing machine |
| 3 | Needle |
| 4 | Sewing machine drive/drive |
| 5 | Guide rod |
| 5' | Spindle |
| 7 | Holder of material for sewing |
| 7' | Holder of material for sewing |
| 9 | Toothed belt |
| 13 | Material for sewing |
| 14 | Bearer |
| 15 | Place of insertion |
| 16 | Place of removal |
| 17 | Guide rod |
| 17a | Guide rod |
| 18 | Bearing |
| 18a | Bearing |
| 19 | Bearing |
| 19a | Bearing |
| 20 | Shaft |
| 21 | Toothed belt pulley |
| 21a | Toothed belt pulley |
| 22 | Toothed belt |
| 23 | Toothed belt pulley |
| 24 | Drive motor |
| 25 | Toothed belt |
| 26 | Toothed belt pulley |
| 27 | Bearing block |
| 28 | Beam |
| 29 | End |
| 29a | End |
| 30 | Bearing member |
| 30a | Bearing member |
| 31 | Intermediate plate |
| 31a | Intermediate plate |
| 32 | Sliding bearing |
| 32a | Sliding bearing |
| 33 | Guide member |
| 34 | Plates |
| 34a | Plates |
| 35 | Toothed belt pulley |
| 36 | Guide wheel |
| 37 | Guide wheel |
| 38 | Shaft |
| 38a | Coupling |
| 39 | Bearing |
| 40 | Drive motor |
| 41 | Notch |
| 41a | Notch |
| 41' | Notch |
| 41a' | Notch |
| 42 | Metal sheet |
| 42' | Metal sheet |

-continued

| List of reference numbers | |
|---|---|
| 43 | Base member |
| 44 | Bottom part |
| 45 | Top part |
| 46 | Lock |
| 47 | Recess |
| 48 | Attachment |
| 49 | Connecting element |
| 50 | Sensor |
| 51 | Direction of conveyance |
| 52 | Edge |
| 55 | Drive motor |
| 56 | Connecting element |
| 57 | Thread |
| N | Shape of seam |

What is claimed is:

1. Sewing apparatus, including a contour sewing machine for a sewing unit, comprising a vertically reciprocating needle and a sewing material holder movable relative thereto which, in order to make a seam having a predetermined shape, is movable in two directions (X, Y) at an angle to one another in a plane, the movements being generated by two independent motors and the holder being releasably connected to a bearer driven in one direction (Y) and coming into engagement with a drive operating in the other direction (X), wherein the holder is releasably mountable via a bearing thereon to an arbitrary position on a guide rod connected to a fixed place on the bearer and is connectable by at least one connecting element to the drive for the other direction (X), which coincides with the direction in which the guide rod extends.

2. Sewing apparatus according to claim 1, wherein the bearing is substantially U-shaped in cross-section and also constitutes the only connection to the guide rod.

3. Sewing apparatus according to claim 2, wherein the bearing is in the form of a recess provided in the holder.

4. Sewing apparatus, including a contour sewing machine for a sewing unit, comprising a vertically reciprocating needle and a sewing material holder movable relative thereto which, in order to make a seam having a predetermined shape, is movable in two directions (X, Y) at an angle to one another in a plane, the movements being generated by two independent motors and the holder being releasably connected to a bearer driven in one direction (Y) and coming into engagement with a drive operating in the other direction (X), wherein the holder is mountable via a bearing thereon, onto a guide rod connected to a fixed place on the bearer and is connectable by at least one connecting element to the drive for the other direction (X), which coincides with the direction in which the guide rod extends, wherein the bearing is substantially U-shaped in cross-section and also constitutes the only connection to the guide rod, and wherein two bearings are provided.

5. Sewing apparatus, including a contour sewing machine for a sewing unit, comprising a vertically reciprocating needle and a sewing material holder movable relative thereto which, in order to make a seam having a predetermined shape, is movable in two directions (X, Y) at an angle to one another in a plane, the movements being generated by two independent motors and the holder being releasably connected to a bearer driven in one direction (Y) and coming into engagement with a drive operating in the other direction (X), wherein the holder is mountable via a bearing thereon, onto a guide rod connected to a fixed place on the bearer and is connectable by at least one connecting element to the drive for the other direction (X), which coincides with the direction in which the guide rod extends, and wherein the connecting element is a toothed pin and the drive for the other direction (X) is a rotating toothed belt cooperative therewith.

6. Sewing apparatus according to claim 5, wherein the toothed belt rotates in a vertical plane.

7. Sewing apparatus, including a contour sewing machine for a sewing unit, comprising a vertically reciprocating needle and a sewing material holder movable relative thereto which, in order to make a seam having a predetermined shape, is movable in two directions (X, Y) at an angle to one another in a plane, the movements being generated by two independent motors and the holder being releasably connected to a bearer driven in one direction (Y) and coming into engagement with a drive operating in the other direction (X), wherein the holder is mountable via a bearing thereon, onto a guide rod connected to a fixed place on the bearer and is connectable by at least one connecting element to the drive for the other direction (X), which coincides with the direction in which the guide rod extends, and wherein the connecting element is a toothed segment and the drive for the other direction (X) is a rotating toothed belt co-operating therewith.

8. Sewing apparatus according to claim 1, wherein the guide rod is round.

9. Sewing apparatus, including a contour sewing machine for a sewing unit, comprising a vertically reciprocating needle and a sewing material holder movable relative thereto which, in order to make a seam having a predetermined shape, is movable in two directions (X, Y) at an angle to one another in a plane, the movements being generated by two independent motors and the holder being releasably connected to a bearer driven in one direction (Y) and coming into engagement with a drive operating in the other direction (X), wherein the holder is mountable via a bearing thereon, onto guide rod connected to a fixed place on the bearer and is connectable by at least one connecting element to the drive for the other direction (X), which coincides with the direction in which the guide rod extends, and wherein the guide rod is round.

10. Sewing apparatus, including a contour sewing machine for a sewing unit, comprising a vertically reciprocating needle and a sewing material holder movable relative thereto which, in order to make a seam having a predetermined shape, is movable in two directions (X, Y) at an angle to one another in a plane, the movements being generated by two independent motors and the holder being releasably connected to a bearer driven in one direction (Y) and coming into engagement with a drive operating in the other direction (X), wherein the holder is mountable via a bearing thereon, onto a guide rod connected to a fixed place on the bearer and is connectable by at least one connecting element to the drive for the other direction (X), which coincides with the direction in which the guide rod extends, and wherein the guide rod is a spindle driven in rotation and forming a part of the drive for the other direction (X).

11. Sewing apparatus according to claim 10, wherein the holder is mounted via a connecting element which engages in the spindle.

12. Sewing apparatus, including a contour sewing machine for a sewing unit, comprising a vertically reciprocating needle and a sewing material holder movable relative thereto which, in order to make a seam having a predetermined shape, is movable in two directions (X, Y) at an angle to one another in a plane, the movements being generated by two independent motors and the holder being releasably connected to a bearer driven in one direction (Y) and coming into engagement with a drive operating in the other direction (X), wherein the holder is mountable via a bearing thereon, onto a guide rod connected to a fixed place on the bearer and is connectable by at least one connecting element to the drive for the other direction (X), which coincides with the direction in which the guide rod extends, wherein the bearing is substantially U-shaped in cross-section and also constitutes the only connection to the guide rod, wherein the bearings is in the form of a recess provided in the holder, and wherein two bearings are provided.

* * * * *